US005356332A

United States Patent [19]

Thompson et al.

[11] Patent Number: 5,356,332

[45] Date of Patent: Oct. 18, 1994

[54] COIN MECHANISM

[75] Inventors: Trevor Thompson; Bernard J. Campbell, both of Hampshire, United Kingdom

[73] Assignee: Mars Incorporated, McLean, Va.

[21] Appl. No.: 972,449

[22] PCT Filed: Jul. 18, 1991

[86] PCT No.: PCT/GB91/01206

§ 371 Date: Jan. 29, 1993

§ 102(e) Date: Jan. 29, 1993

[87] PCT Pub. No.: WO92/02906

PCT Pub. Date: Feb. 20, 1992

[30] Foreign Application Priority Data

Aug. 1, 1990 [GB] United Kingdom ..... 9016861.8

[51] Int. Cl.[5] ..... G07D 3/14; G07D 9/06

[52] U.S. Cl. ..... 453/3; 453/17; 453/61

[58] Field of Search ..... 453/3, 4, 16, 17, 61, 453/62; 53/212, 254, 532

[56] References Cited

U.S. PATENT DOCUMENTS

| | | | |
|---|---|---|---|
| 4,347,924 | 9/1982 | Hayashi et al. | 194/346 |
| 4,374,529 | 2/1983 | Kobayashi et al. | 453/17 |
| 4,606,360 | 8/1986 | Mills | 53/254 X |
| 5,052,538 | 10/1991 | Satoh | 453/17 |

FOREIGN PATENT DOCUMENTS

| | | |
|---|---|---|
| 397353 | 11/1990 | European Pat. Off. . |
| 925985 | 5/1963 | United Kingdom . |
| 1415162 | 11/1975 | United Kingdom . |
| 2065950 | 7/1981 | United Kingdom . |
| 2138192 | 10/1984 | United Kingdom . |

OTHER PUBLICATIONS

Mar. 18, 1991 Search Report of corresponding Great Britain application.

Jan. 2, 1991 Search Report of corresponding Great Britain application.

International Search Report of corresponding PCT application No. PCT/GB91/01206.

*Primary Examiner*—F. J. Bartuska

*Attorney, Agent, or Firm*—Davis Hoxie Faithfull & Hapgood

[57] ABSTRACT

A coin mechanism comprising testing devices for testing coins as to their acceptability, a substantially upright coin store or tube adapted to contain a plurality of acceptable coins of a particular denomination up to a predetermined upper level, and a coin dispenser for dispensing coins from the lower end of the store. The coin store is provided with a coin inlet located below the predetermined upper level, and devices for delivering acceptable coins of the denomination from the testing devices through the inlet into the store. This enables the coin store to be pre-loaded to the upper level and, when its contents have been partly dispensed, to be refilled from the coin tester, through the coin inlet at the lower level.

12 Claims, 1 Drawing Sheet

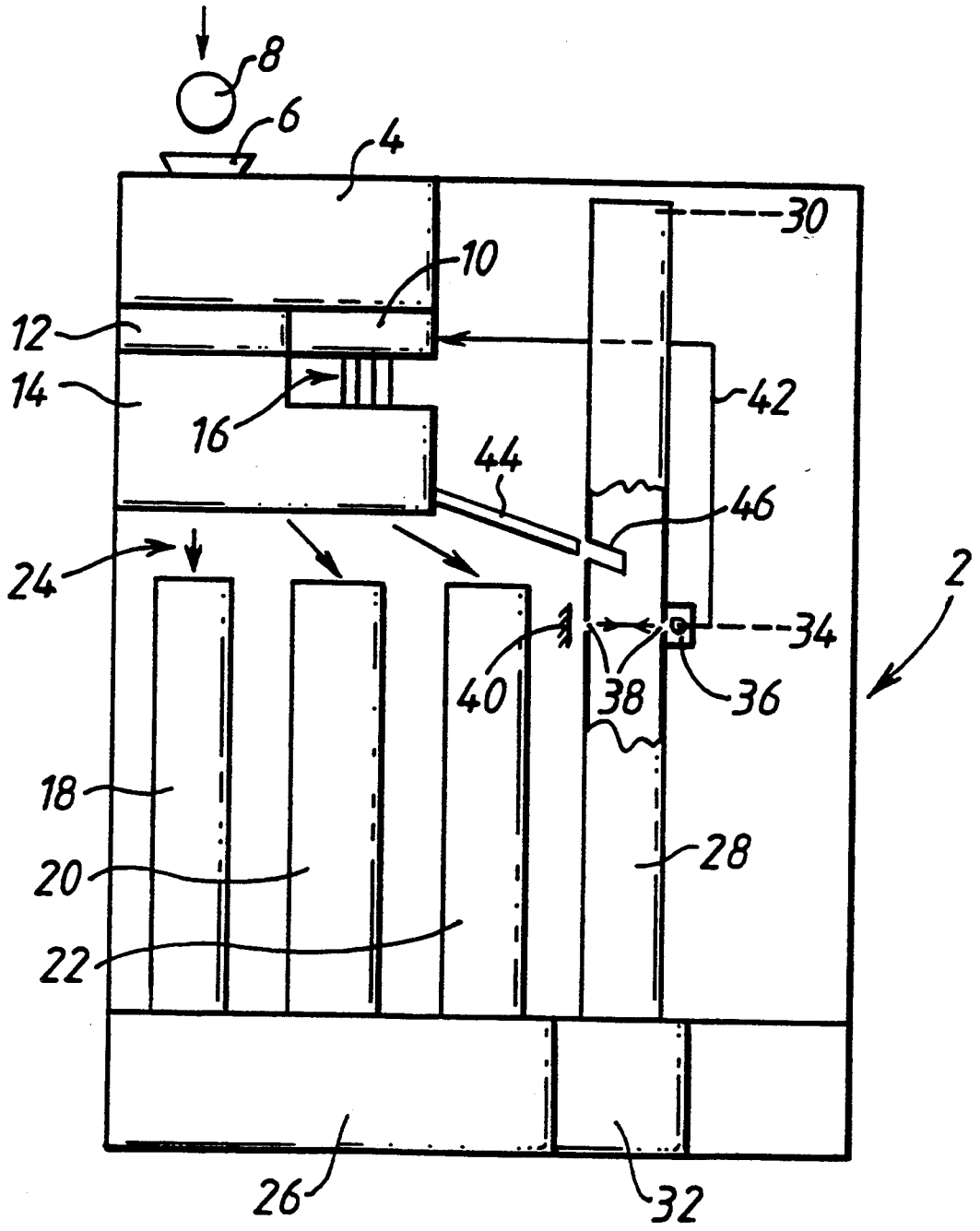
8
6
4
30
10
12
14
16
42
44
46
24
2
34
40
38
36
18
28
20
22
26
32

COIN MECHANISM

FIELD OF THE INVENTION

This invention relates to coin mechanisms.

BACKGROUND OF THE INVENTION

The term "coin" when used herein includes genuine coins, tokens, counterfeit coins and any other objects which may be inserted into a coin mechanism in an attempt to obtain any kind of goods or services.

Coin mechanisms are well known, which test coins as to their acceptability and, if acceptable, indicate their denomination, and which in respect of at least some of the acceptable denominations, direct them to respective coin stores, these usually being in the form of coin tubes, which may have different diameters depending upon the particular coin denomination each is intended to contain, and which are adapted to hold the coins in a vertical stack face-to-face. A coin dispensing arrangement is provided for dispensing appropriate combinations of coins from the bottoms of the stacks for the purpose of giving change or providing prizes. Additionally, there is usually a cashbox to which are directed coins which it is not intended to dispense either as change or as prizes, and also coins which might normally be directed to specific coin stores but which are accepted when the particular coin store in question is already full.

Coin mechanisms of this general type are well known and widely sold.

It is also known that there are some situations in which a particular coin denomination will need to be dispensed, in change or as a prize, sufficiently often that the coin store for that denomination is likely to become exhausted more frequently than is desirable. In an attempt to reduce the resulting problems, some coin mechanisms have been adapted to be equipped with an "auxiliary" coin tube which is individually mountable to, and demountable from, the coin mechanism manually without the use of tools. The auxiliary coin tube is pre-loaded manually with coins of the frequently-used denomination and mounted to the coin mechanism. There are then available for dispensing whatever coins may be already in, or delivered to, the main coin tube for that denomination, plus the quantity of coins of that denomination contained in the auxiliary tube. Over a period of time, nevertheless, it is still likely that the supply of coins of that denomination will become exhausted in which case the auxiliary tube will need to be manually replenished or replaced by a new one pre-loaded with a further supply of the frequently-used denomination of coin. To minimise the frequency with which the auxiliary coin tube has to be manually replenished or exchanged for a new, full, one it is desired for its capacity to be as great as possible, that is to say for its height also to be as great as possible.

SUMMARY OF THE INVENTION

An object of the present invention is to reduce the frequency with which a large-capacity coin store has to be manually replenished or replaced with a pre-loaded new one.

The invention provides a coin mechanism comprising testing means for testing coins as to their acceptability, a substantially upright coin store adapted to contain a plurality of acceptable coins of a particular denomination up to an upper level, and a coin dispenser for dispensing coins from the lower end of the store, characterised in that said coin store is provided with a coin inlet located below said upper level, and in that means is provided for delivering acceptable coins of said denomination from the testing means through said inlet into the store.

The fact that coins can be delivered into the store at a level lower than the predetermined upper level for stored coins means that the height, and therefore the capacity, of the coin store can be as great as is permissible within whatever space is available yet, at the same time, the store can also be replenished through the inlet, which can be positioned at a level at or below that to which coins can be delivered after having passed by gravity through the testing means and a coin separator which normally will be present for the purpose of separating different denominations of accepted coins and routing them to appropriate different destinations.

It is to be expected that the number of coins of the frequently-used denomination that can be delivered to the coin store in this way will be sufficient that it will not become exhausted for a substantially longer period than would otherwise be the case and hence manual replenishment of the coin store, or its replacement by a new pre-loaded one, will need to be done less frequently.

From a still further aspect of the invention, there is provided a method of providing a coin mechanism, which includes coin testing means, with coins of a particular denomination for being dispensed from the mechanism, comprising adding to the mechanism a substantially upright coin store pre-loaded to a predetermined level with such coins, accepting further coins of said denomination into the mechanism through said coin testing means, dispensing coins from said coin store, and when its contents are below a lower level, directing into the coin store at said lower level accepted coins of said denomination.

In order that the invention may be more clearly understood an embodiment thereof will now be described with reference to the accompanying diagrammatic drawing.

DESCRIPTION OF THE DRAWINGS

The FIGURE is side view of the internal configuration of a coin mechanism in accordance with the present invention.

DETAILED DESCRIPTION

In the drawing, a coin mechanism 2 comprises coin testing means 4 having an inlet 6 for coins 8 to be tested. A microprocessor 10 is schematically illustrated, which normally will form part of the testing means. Microprocessor 10 compares measurements which are taken on the coin by the testing means with reference values appropriate to various different denominations of acceptable coins. When the comparison indicates that the coin inserted is acceptable the microprocessor provides a signal which causes power application to the actuator, normally a solenoid, of an accept/reject gate 12 which moves to a position such that the coin is delivered into a coin separator 14. If the coin is not found acceptable, the actuator of the accept/reject gate is not powered and so remains in a reject position such that the coin takes a path (not shown) back to the exterior of the mechanism where the customer can retrieve it.

When a coin is acceptable, the microprocessor 10 also provides a signal, on output lines 16, indicative of the denomination of the coin. Coin tubes 18, 20 and 22 are provided each of which is intended in normal operation to receive accepted coins of a particular respective denomination.

The coin separator 14 is actuated in response to the coin denomination as indicated by the output signal on line 16, so as to direct the coin, in dependence upon its denomination, towards the correct one of the tubes 18, 20 and 22 on one of the paths generally indicated by the arrows 24, if necessary via a suitable manifold. Actuation of the separator may consist of energising the appropriate ones of a plurality of solenoids which control the configuration of a set of gates, or the appropriate positioning of a motor which in turn positions a coin guide to direct a coin through the appropriate one of several outlets of the separator.

When there is a requirement for change to be given, or for a prize to be paid out, a dispensing unit 26 is operated in well-known manner to dispense to the customer the appropriate coin or combination of coins from the bottoms of the coin stacks in tubes 18, 20 and 22, operation of the dispensing unit also being controlled by the microprocessor 10.

The principles of operation and construction of the mechanism as just described are all known to the man skilled in the art and therefore further detailed description is not required.

As has previously been mentioned, there will be certain circumstances in which a particular coin denomination, for example that contained in coin tube 22, needs to be dispensed particularly frequently. To maximise the supply of coins of this denomination in the mechanism, an auxiliary coin tube 28 is provided which, outside the mechanism, can be pre-loaded with coins of that particular denomination to an upper level 30.

Thus pre-loaded, the auxiliary coin tube 28 is individually mounted to the coin mechanism manually, the mounting arrangements being of any simple type not requiring the use of tools, such as snap-in or push-in fittings, so that mounting, and at a later time demounting, of the auxiliary coin tube can be done quickly and easily. For dispensing from the bottom of the auxiliary coin tube, the coin mechanism is fitted with an additional separate dispenser section 32.

It can be seen from the drawing that auxiliary coin tube 28 extends for virtually the whole of the available height within the coin mechanism and hence its capacity is maximised.

When there is a requirement to dispense one or more coins of the denomination contained in tubes 22 and 28, such dispensing may be done from tube 22 provided it contains sufficient coins for the purpose. A conventional detector may be used to detect that there are coins in tube 22 and inform microprocessor 10 accordingly, so that microprocessor 10 can instruct the dispensing of one or more coins from that tube. Microprocessor 10 may be programmed such that in the event that a lack of coins in tube 22 is indicated, it instead causes actuation of dispenser section 32 so as to dispense the necessary coins from auxiliary tube 28. Associated with auxiliary coin tube 28, at level 34, there is a coin-level sensor of generally known kind which comprises a light source and a light detector together indicated at 36 on one side of the tube, respective apertures 38 on opposite sides of the tube, and a reflecting arrangement 40. A light beam passes from the light source through the first aperture, across the tube, through the second aperture, is reflected by the reflector 40 and returns along the same or a similar path through the apertures to the detector.

So long as auxiliary tube 28 contains coins to above the level 34 the light beam will be interrupted and this is indicated to the microprocessor 10 on an output line 42. Microprocessor 10 is programmed such that in this situation it will cause the separator 14 to direct coins of the denomination contained in tubes 22 and 28 always to tube 22 or, if that happens to be full, to a cashbox.

However, when the coin level detector associated with tube 28 does not have its beam broken, indicating that the coin level is below level 34, this is indicated to microprocessor 10 over line 42 and the microprocessor is programmed such that in that situation it will cause separator 14 to direct accepted coins of the denomination contained in tubes 22 and 28 through an additional exit shown as a chute 44 which delivers them to an angled slot 46 forming an inlet to auxiliary tube 28 located just above level 34. Since in this situation the existing coin level is below level 34 the coins in tube 28 will not obstruct the introduction of a further coin through entry 46. If the existing level were higher, there is a possibility that this would happen and that a jam would be caused in tube 28, but this avoided by the coin level detector once again inhibiting delivery of coins to tube 28 in response to detecting the increased coin level in tube 28.

Instead of the stored coin level being sensed directly, it may be deduced by measuring when the coins are at a reference level, counting incoming & outgoing coins, and using the difference as an indicator of the present level relative to the reference level, this being a known technique.

It will be appreciated that the auxiliary coin tube 28 might be utilised simply to enable the basic mechanism to accept, store and dispense an extra, in this case a fourth, denomination of coin.

Although the invention has been described, with reference to the embodiment, in relation to coin tubes, it is not essential that the coin store or stores should be of tubular form. The invention would be applicable to any type of coin store which operates in an upright position and in which the remaining stored coins move downwards as coins are dispensed from the store, as for example in GB-A-2229306.

We claim:

1. A coin mechanism comprising testing means for testing coins as to their acceptability, a substantially upright coin store adapted to contain a plurality of acceptable coins of a particular denomination up to an upper level, and a coin dispenser for dispensing coins from the lower end of the store, characterised in that said coin store is provided with a coin inlet located below said upper level, and means is provided for delivering acceptable coins of said denomination from the testing means through said inlet into the store.

2. A coin mechanism as claimed in claim 1 characterised by means for preventing the delivering means from delivering coins to said store when the stored coins are up to a predetermined level below said inlet.

3. A coin mechanism as claimed in claim 2 wherein said means for preventing includes a coin level sensor located below said inlet.

4. A coin mechanism as claimed in claim 1 wherein the coin store is adapted to contain the stored coins in a column stacked face-to-face.

5. A coin mechanism as claimed in claim 4 wherein the coin store is a coin tube.

6. A coin mechanism as claimed in claim 1 which includes one or more further coin stores, and at least one of them is adapted to contain a plurality of coins of the same denomination as the first mentioned coin store.

7. A coin mechanism as claimed in claim 6 wherein the first-mentioned coin store is individually mountable to, and demountable from, the coin mechanism.

8. A coin mechanism as claimed in claim 7 wherein the first-mentioned coin store is so mountable and demountable manually without the use of tools.

9. A coin mechanism as claimed in claim 6 wherein the first mentioned coin store is filled with coins to said upper level.

10. A coin mechanism as claimed in claim 1 comprising a coin separator for separating accepted coins of different denominations and wherein said upper level is at a higher level than the lower end of the coin separator.

11. A method of providing a coin mechanism, which includes coin testing means, with coins of a particular denomination for being dispensed from the mechanism, comprising adding to the mechanism a substantially upright coin store pre-loaded to a predetermined level with such coins, accepting further coins of said denomination into the mechanism through said coin testing means, dispensing coins from said coin store, and when its contents are below a lower level, directing into the coin store at said lower level accepted coins of said denomination.

12. A coin mechanism for accepting coins of a plurality of denominations, the coin mechanism comprising:

a coin validator, a coin separator which separates accepted coins by denomination, the coin separator having a lower end, a cashbox, a plurality of coin tubes for at least one of the denominations which can be accepted by the coin mechanism, wherein the coin separator can direct acceptable coins to an appropriate coin tube or the cashbox, and an auxiliary coin tube for storing coins of a particular denomination which can be accepted by the coin mechanism, the auxiliary coin tube having an upper level above the lower end of the coin separator and a coin inlet below the upper level of the auxiliary coin tube, wherein coins of an appropriate denomination can be directed into the auxiliary coin tube through the coin inlet when the level of coins in the auxiliary coin tube is below a predetermined level.

* * * * *